US005521608A

United States Patent [19]

Brandt et al.

[11] Patent Number: 5,521,608

[45] Date of Patent: May 28, 1996

[54] MULTIBAY COPLANAR DIRECTION FINDING ANTENNA

[75] Inventors: Robert L. Brandt, Anamosa; Allen E. Tupker, Marion, both of Iowa

[73] Assignee: Rockwell International, Seal Beach, Calif.

[21] Appl. No.: 200,980

[22] Filed: Feb. 24, 1994

[51] Int. Cl.[6] ..... H01Q 9/00

[52] U.S. Cl. ..... 343/749; 343/810; 343/812

[58] Field of Search ..... 343/749, 722, 343/853, 893, 751, 745, 826, 827, 810, 812, 813; H01Q 9/00

[56] References Cited

U.S. PATENT DOCUMENTS

| | | | |
|---|---|---|---|
| 2,688,083 | 8/1954 | Hills | 343/801 |
| 3,035,266 | 5/1962 | Marshall | 343/801 |
| 3,680,146 | 7/1972 | Leitner et al. | 343/792 |
| 3,750,184 | 7/1973 | Kuecken | 343/792 |
| 3,824,596 | 7/1974 | Guion et al. | 343/113 R |
| 4,125,840 | 11/1978 | Cassel | 343/807 |
| 4,496,953 | 1/1985 | Spinks, Jr. et al. | 343/792 |

*Primary Examiner*—Hoanganh Le
*Attorney, Agent, or Firm*—Kyle Eppele; M. Lee Murrah; George A. Montanye

[57] ABSTRACT

A multiband direction finding antenna comprised of numerous antenna elements, of coplanar location. The antenna elements associated with lower band frequencies are provided with chokes, so that unchoked sections do not exceed one-quarter wavelength of the high-band, highest frequency.

8 Claims, 1 Drawing Sheet

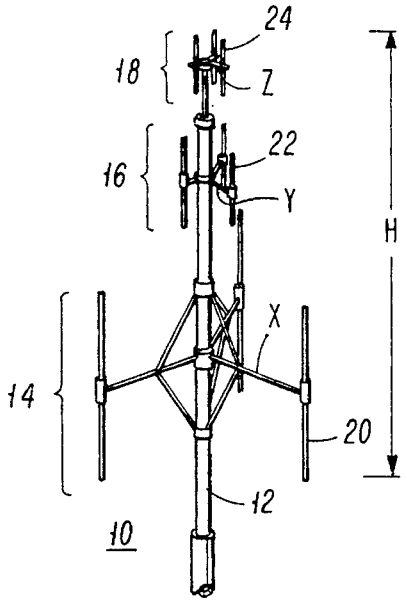
FIG. 1 PRIOR ART
FIG. 2
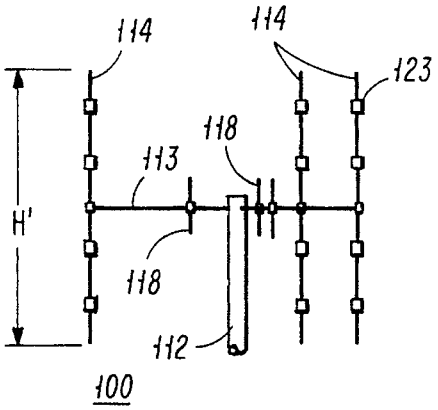
FIG. 3
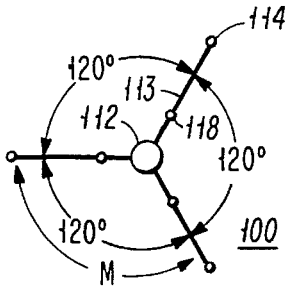
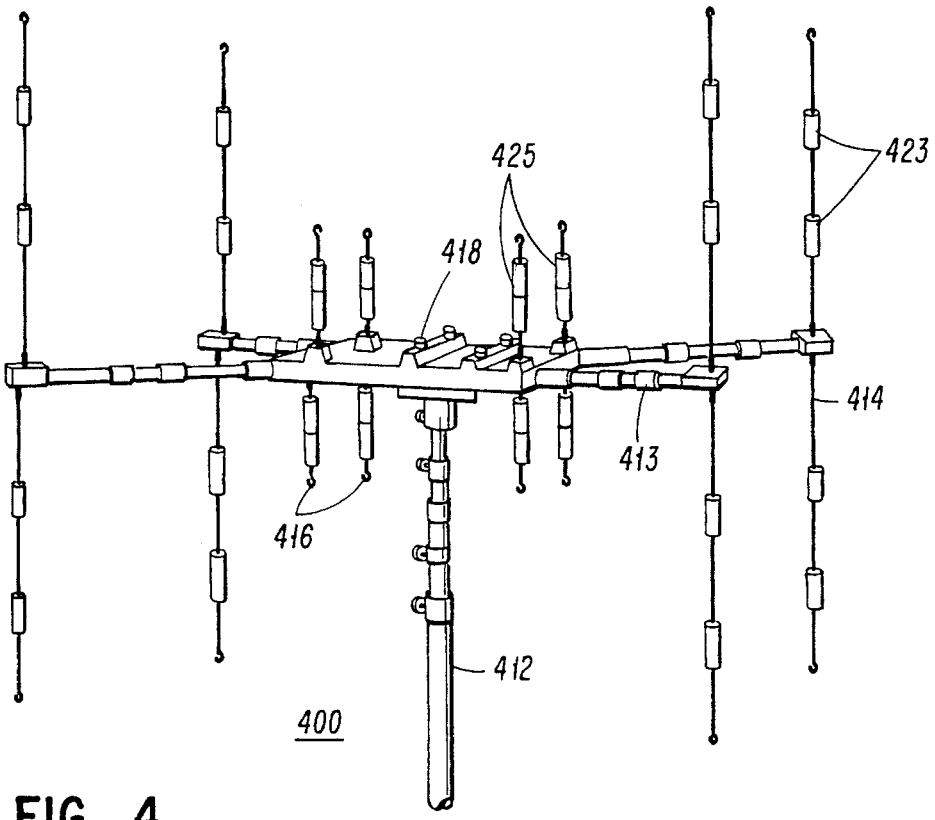
FIG. 4

MULTIBAY COPLANAR DIRECTION FINDING ANTENNA

BACKGROUND OF THE INVENTION

This invention relates to radio direction finder (df) apparatus, and more particularly to antenna apparatus for use with df receiver radios.

Radio direction finders measure the direction of arrival of a given radio signal. Typical direction finder systems are comprised of an antenna for detecting the desired wave signal, receiver means to limit the signal bandwidth, a processor to interpret the significance of the detected signal and output means for making use of the processed information.

A radio signal is actually a traveling wave that radiates outward from its exciter. The phase progression of the radio signal is the fundamental characteristic used by df systems to provide location information of the source of the wave. Typical df antennas are comprised of a plurality of elements and operate by determining the angle of arrival (azimuth) of a respective wave signal, thereby providing phase difference data necessary to determine df characteristics. Multiband df antenna typically cover frequency ranges of 20 to 1200 MHz. In order to avoid interaction of closely spaced antenna elements, each band of a multiband df antenna normally resides in its own plane. Although this "stacked wedding cake" approach provides nominal radio operation, the physical dimensions are often burdensome or unacceptable for certain applications.

Accordingly, a need exists for a df multiband antenna apparatus in which the low frequency band antenna elements define the required dimensions of the antenna.

SUMMARY

A multiband direction finding antenna of compact design. A multiband df antenna comprised of a plurality of antenna elements, each located within a given horizontal plane. Those antenna elements dedicated to lower band frequencies such that unchoked sections of low-band elements do not exceed one-quarter wavelength at the highest operating frequency of the high frequency band elements.

One embodiment of the present invention is comprised of a plurality of choke elements strategically located on lower band frequency elements in order to prevent unwanted resonance of higher frequencies.

It is therefore an object of the present invention to provide an antenna apparatus for accomplishing df signal sampling.

It is a feature of the present invention that the df antenna apparatus is comprised of a plurality of coplanar antenna elements.

It is yet another feature of the present invention the low-band antenna elements have strategically located choke elements that reduce or eliminate interference between antenna elements of different frequency bands.

It is an advantage of the present invention that a multiband df antenna is provided in which all antenna elements are coplanar located.

The foregoing as well as other objects, features and advantages of the present invention will become better understood from the following detailed description taken in conjunction with the various views of the appended drawings.

BRIEF DESCRIPTION OF THE DRAWINGS

FIG. 1 is a perspective view of a prior art multiband df antenna as known in the prior art.

FIG. 2 is a side view of one embodiment of an apparatus incorporating the teachings of the present invention.

FIG. 3 is a top view of the apparatus of FIG. 2.

FIG. 4 is a perspective view of an alternate embodiment of an apparatus incorporating the teachings of the present invention.

DETAILED DESCRIPTION OF THE DRAWINGS

Turning now to the drawings, wherein like items are referred to as such throughout, FIG. 1 is a perspective view of a multiband df antenna 10 as known in the prior art. A mast 12 supports a plurality of low frequency range antenna elements 14, mid-range frequency antenna elements 16 and high-range frequency elements 18. As shown, the plurality low-range elements or low-range bay 14 has each of its antenna elements 20 rigidly supported cross members X from the mast 12. Similarly, mid-range antenna elements 22 are distanced from the mast 12 by cross members Y, and high-range antenna elements 24 are distanced from the mast by cross members Z. As depicted in FIG. 1, the value of X is greater than Y is greater than Z. The height dimension H of antenna 10 includes the height dimensions of the low, mid, and high-range bays 14, 16, 18, plus any vertical spacing between them.

Operationally, the "stacked wedding cake" configuration of antenna 10 provides suitable separation of the different range antenna elements, so as to avoid related interference. The various frequency range bays form interferometers, providing df properties by processing the phase of the received signal of the respective elements. Unfortunately, the height H of antenna 10 is often unacceptable for given applications.

FIG. 2 illustrates a side view of one implementation of a df antenna incorporating the teachings of the present invention. The antenna 100 is shown having low-range antenna elements 114 and high-range antenna elements 118 coupled to a mast 112 by cross members 113. As with the apparatus of FIG. 1, the df capabilities of antenna 100 are provided by the variously identified elements serving as an interferometer. A plurality of choke elements 123 are strategically located on each of the lower range antenna elements 114. The choke elements 123 were constructed of toroid-shaped ferrite material. The low-range antenna elements 114 are rod-shaped in appearance having such physical dimensions so that the choke elements 123 readily slide over the low-range antenna elements 114. The location of choke elements 123 is chosen so that the resulting unchoked section of low-range antenna elements 114 do not exceed one-quarter wavelength at the highest operating frequency of the high-range antenna elements 118. This assures that the high-range antenna elements 118 do not experience resonance attributable to the low-range antenna elements 114.

FIG. 3 illustrates a top view of the apparatus of FIG. 2. Cross members 113 are shown supporting a high-range antenna element 118 and a low-range antenna element 114. Each cross member 113 is radially separated from the other two by a 120° arc, represented by arrow M.

Referring now to the apparatus of FIGS. 2 and 3, one specific implementation provides frequency coverage from 100 to 2,000 MHz. As constructed the low-band elements provided coverage in the 100–500 MHz range and the high-band elements provided coverage up to 2,000 MHz. A quarter wavelength at the highest operating frequency of the high bay was determined to be 1.5 inches. Accordingly, the unchoked lengths of the low-band elements were each selected so as not to exceed 1.5 inches in length.

The chokes were chosen so that their operable effect was minimized at the highest operating frequency of the low frequency band. In the above specific embodiment, the highest operating frequency for the low-range antenna elements was 500 MHz, and the associated transition from no-choke condition to full-choke condition is 2,000:500 MHz, over a two octave bandwidth.

The choke elements in the above example were made from ferrite material, shaped as toroids of such dimension as to snugly engage the low-band antenna elements. A choke element was positioned at the high current nodes on each of the low frequency band antenna elements. The high current nodes (for high frequency band signals) are located one-quarter wavelength away from the end of the low-band elements and a distance equal to one-quarter wave length thereafter. The lossy nature of the ferrite chokes allows the high frequency band energy in the low frequency antenna elements to be absorbed by the chokes, thereby preventing any resonance. Since the low-band signals do not produce high current nodes, the chokes do not effect low-band signal reception.

Although described above as a df antenna having only low-band and a high-band range, the teachings of the present invention also apply to additional divisions of frequencies, such as the three band apparatus of FIG. 4. FIG. 4 illustrates a perspective view of another embodiment of a df antenna 400 incorporating the teachings of the present invention. A mast 412 provides support to four support member 413, which in turn, each support a high-frequency element 418, a mid-frequency element 416 and a low-frequency element 414. The mid-frequency elements 416 have chokes 425 (constructed as described above) located at intervals of one-quarter wavelength distance with respect to the high-frequency band signals. Similarly, low-frequency elements 414 have chokes 423 located at designated high current nodes of the mid-band signals. The spacing of the chokes 425 and 423 on elements 414 and 416 is set to avoid resonances that would be produced in a higher frequency band. Separation between the low-frequency element 414 and the high-frequency elements 418, is sufficient so that the interfering resonance effects are negligible. Each support member 413 extends outward in the same plane as the other support members, but at a point located 90° radially with respect to adjacent support members.

Those skilled in the art will readily recognize that various modifications and changes may be made to the present invention without departing from the true spirit and scope thereof, which is set forth in the following claims.

We claim:

1. A multibay direction finding antenna comprising:

a plurality of antenna elements of a first length symmetrically aligned in a given plane;

a plurality of antenna elements of a second length, such second length lesser in magnitude than the first length, symmetrically aligned in the same plane as the antenna elements of the first length; and a plurality of choke devices strategically located on each antenna element of the first length so that resonance from higher frequency signals are eliminated in the antenna elements of the first length.

2. The apparatus of claim 1 further including a plurality of antenna elements of a third length, such length greater in magnitude than the first and second lengths of antenna elements, and symmetrically aligned in the same plane as the other antenna elements and also including a plurality of choke devices strategically located on each antenna element of the third length so that resonance from higher frequency signals is eliminated in the antenna elements of the third length.

3. The apparatus of claim 1 wherein the choke devices are comprised of ferrite material.

4. The apparatus of claim 1 wherein the choke devices are shaped as toroids and held in proper location by frictional forces between the choke devices and the antenna element.

5. A multibay direction finding antenna comprising:

a plurality of antenna elements of a first length symmetrically aligned in a given plane;

a plurality of antenna elements of a second length, such second length lesser in magnitude than the first length, symmetrically aligned in the same plane as the antenna elements of the first length; and a plurality of choke devices located on each antenna element of the first length at one-quarter wavelength distance with respect to the high frequency band signals so that resonance from higher frequency signals are eliminated in the antenna elements of the first length.

6. The apparatus of claim 5 further including a plurality of antenna elements of a third length, such length greater in magnitude than the first and second lengths of antenna elements, and symmetrically aligned in the same plane as the other antenna elements and also including a plurality of choke devices located on each antenna element of the third length at one-quarter wavelength distance with respect to the high frequency band signals so that resonance from higher frequency signals is eliminated in the antenna elements of the third length.

7. The apparatus of claim 5 wherein the choke devices are comprised of ferrite material.

8. The apparatus of claim 5 wherein the choke devices are shaped as toroids and held in proper location by frictional forces between each choke device and each antenna element.

* * * * *